US005850928A

United States Patent [19]

Kahlman et al.

[11] Patent Number: 5,850,928

[45] Date of Patent: Dec. 22, 1998

[54] ARRANGEMENT FOR A VERTICAL AND HORIZONTAL GOODS HOIST

[76] Inventors: Sture Kahlman; Johan Olsson, both of Bengtsfors, Sweden

[21] Appl. No.: 312,118

[22] Filed: Sep. 26, 1994

Related U.S. Application Data

[63] Continuation-in-part of Ser. No. 781,155, Oct. 31, 1991, Pat. No. 5,350,075.

[30] Foreign Application Priority Data

May 2, 1989 [SE] Sweden ..... 8901579
Jan. 2, 1990 [SE] Sweden ..... 9000003

[51] Int. Cl.[6] ..... B66C 13/12

[52] U.S. Cl. ..... 212/285; 212/315; 212/289; 212/312

[58] Field of Search ..... 414/281–284; 212/284, 290, 312–317, 320–323, 225, 328, 344, 346; 254/270, 279, 323, 362, 380; 200/5 R, 6 A

[56] References Cited

U.S. PATENT DOCUMENTS

| | | | |
|---|---|---|---|
| 2,940,608 | 6/1960 | Underwood et al. | 212/162 |
| 3,084,805 | 4/1963 | McKinnon | 212/159 |
| 4,291,213 | 9/1981 | Felland et al. | 200/6 A |
| 4,520,894 | 6/1985 | Hensler | 200/6 A |
| 4,723,458 | 2/1988 | Blok | 200/6 A |

FOREIGN PATENT DOCUMENTS

| | | | |
|---|---|---|---|
| 20593 | 1/1961 | Germany | 212/216 |
| 2918010 | 11/1980 | Germany | 212/138 |

*Primary Examiner*—David A. Bucci
*Assistant Examiner*—R. B. Johnson
*Attorney, Agent, or Firm*—Dvorak & Orum

[57] ABSTRACT

Arrangement for a goods hoist which has an operating control capable of being actuated by a driving device and is situated between a load device and the driving device. The driving device is controlled by electronics that communicate with a transmitter contained in an operating controller.

1 Claim, 12 Drawing Sheets

ARRANGEMENT FOR A VERTICAL AND HORIZONTAL GOODS HOIST

This is a continuation-in-part of application U.S. Ser. No. 07/781,155 filed on 31 Oct. 1991, now U.S. Pat. No. 5,350,075.

The present invention relates to an arrangement for a load hoist which consists of a load device capable of being supported by a lifting cable, etc., and driving means arranged for the driving of the load device in a horizontal direction.

The principal object of the present invention is, in the first place, to make available an arrangement of the kind referred to above which permits the drive for the load device to be influenced in a lateral sense through the lateral movement of the lifting cable.

Said object is achieved by means of an arrangement in accordance with the present invention, which is characterized essentially in that the driving means is so arranged as to be capable of actuation by the movement of the lifting cable in the lateral sense in order to be capable of displacing a supported load device together with the associated load in question in the appropriate direction on the intended occasions, for example when the load personnel are manoeuvring the load device manually and are causing it to move in the direction in which it is wished to move the load by means of the driving means referred to.

The present invention also relates to an arrangement for a goods hoist which comprises an operating control capable of being actuated by a driving device and situated between a load device and driving devices.

Another principal object of the present invention is in the first place to make available an arrangement of the kind described above which is simple and which functions efficiently without the need for great muscle power on the part of the uset.

Said object is achieved by means of an arrangement in accordance with the present invention, which is characterized essentially in that the driving device is so arranged as to be controlled by electronics or by some other means which are capable of being connected to a transmitter contained in said operating control capable of manual actuation.

BRIEF DESCRIPTION OF THE DRAWINGS

The invention is described below as a number of preferred embodiments, in conjunction with which reference is made to the drawings, in which

FIG. 3 shows a section through the trolley and the lifting cable and its patterns of movement from one side, rotated through approximately 90° from its actual direction of movement;

FIG. 4 illustrates the overhead crane trolley viewed from above, with the pattern of movement of the trolley indicated;

FIG. 5 shows a view from above of the travelling crane trolleys;

FIG. 6 shows a side view of the overhead crane trolleys along the arrows VI—VI in FIG. 5;

FIG. 7 shows a partially view of a cable movement transmission element applied in the example in accordance with FIGS. 5–9;

FIG. 8 illustrates the cable movement transmission element in greater detail;

FIG. 9 shows the load lifting arrangement in a perspective view looking from above at an angle;

FIG. 10 shows a load lifting arrangement in a perspective view from the side looking from below;

FIG. 11 finally shows said load lifting arrangement in a perspective view looking from the front.

DETAILED DESCRIPTION OF THE INVENTION

Figure 1:
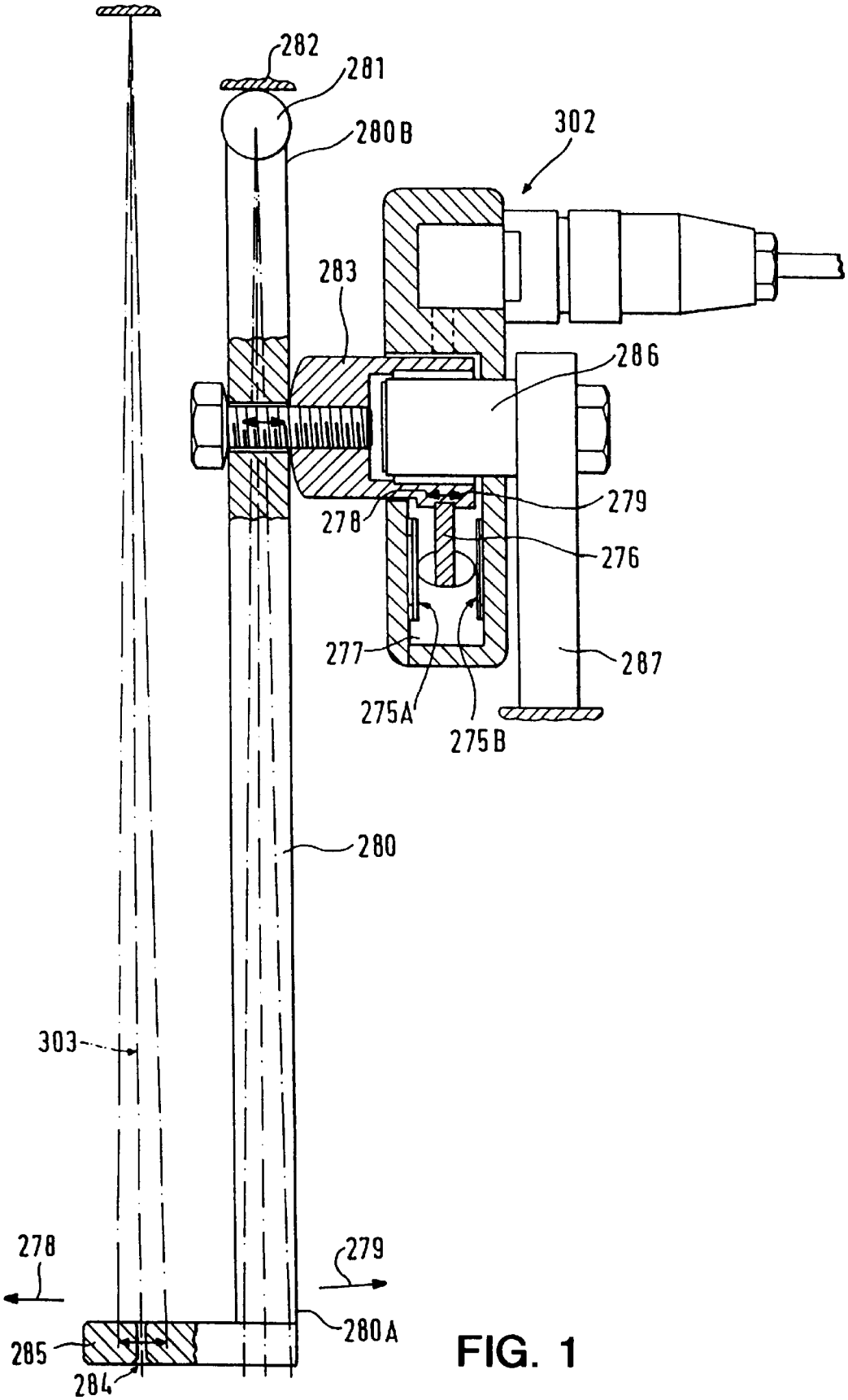
FIG. 1 shows a partially sectioned view of a cable movement transmission element.

A load hoist 1, preferably of a kind capable of manual operation, for example with driving means capable of being controlled electrically or by other means, may be suitable for application to an arrangement 2 of the intended kind in accordance with the present invention, which consists of a load device 4, for example a hook, magnet, suction component, etc., capable of being supported by a lifting cable 3, together with driving means 5 arranged for driving the load device 4 in a horizontal direction 6, 7.

Suitable preferred solutions, in which the load device 4 can be applied so that it is capable of lateral displacement, are illustrated in FIG. 2, FIGS. 3–4, FIGS. 5–6 and FIGS. 10–11.

Figure 2:
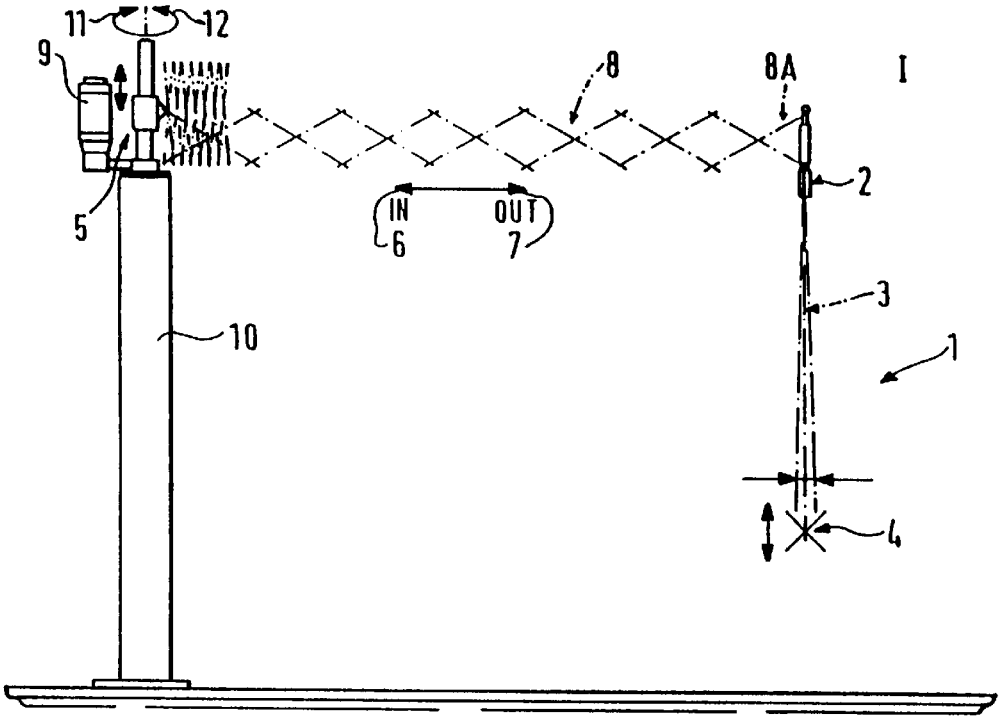
FIG. 2 illustrates diagrammatically an example of a lifting cable supported on a scissor arm.

In the case of a first illustrative embodiment I, which is illustrated in FIG. 2, a load device 4 is supported at one end 8A of a lifting and swinging arm 8, the function of which permits lateral variation 6–7 in its length, which arm consists of a so-called scissor arm in the illustrated example, although other types of arm whose length can be varied between a contracted storage position, for example, and an extended position ready for lifting can be considered, for example a telescopic arm or a so-called flexible arm, although these latter arms are not shown in FIGS. 1–2 in the drawings. The pivoting of the arm 8 can be effected by means of a separate motor, or by means of the standard motor 9 of the load hoist.

The arm 8 can also be supported by a vertical upright 10, about which the arm 8 of the upright 10 is rotated in the desired direction 11, 12.

Figure 3:
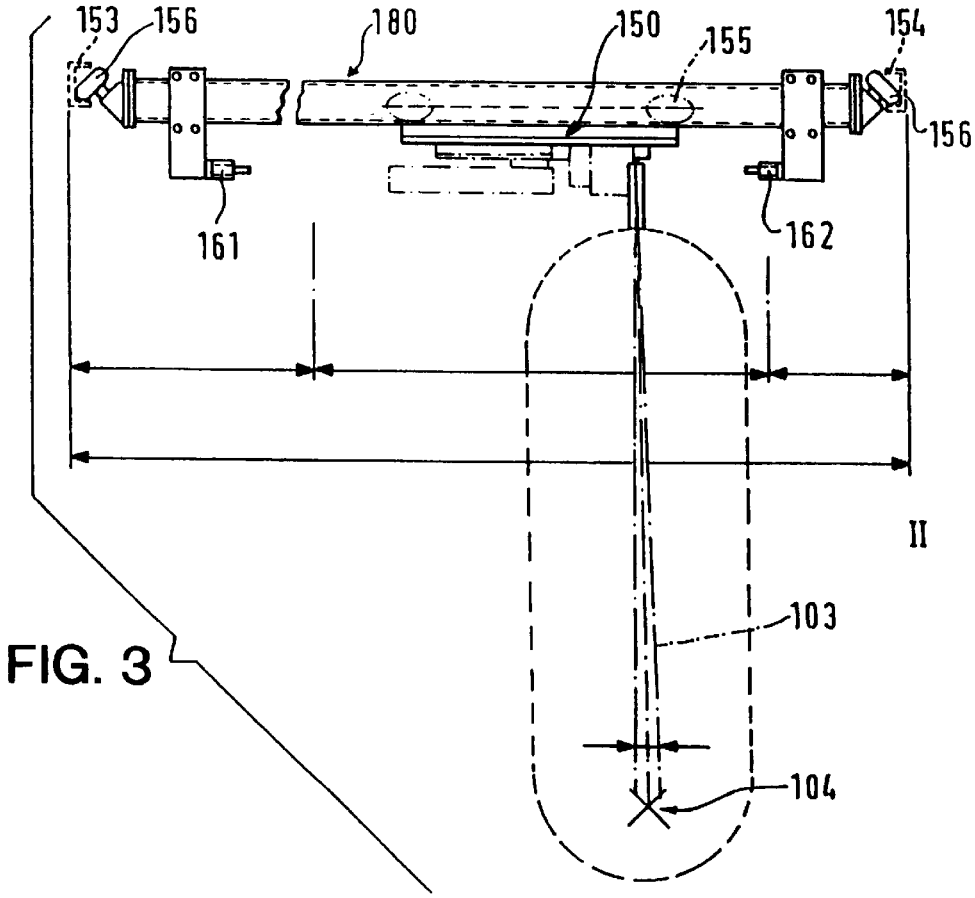
FIGS. 3–4 illustrate diagrammatically an example of a lifting cable supported on overhead crane trolleys.
Figure 4:
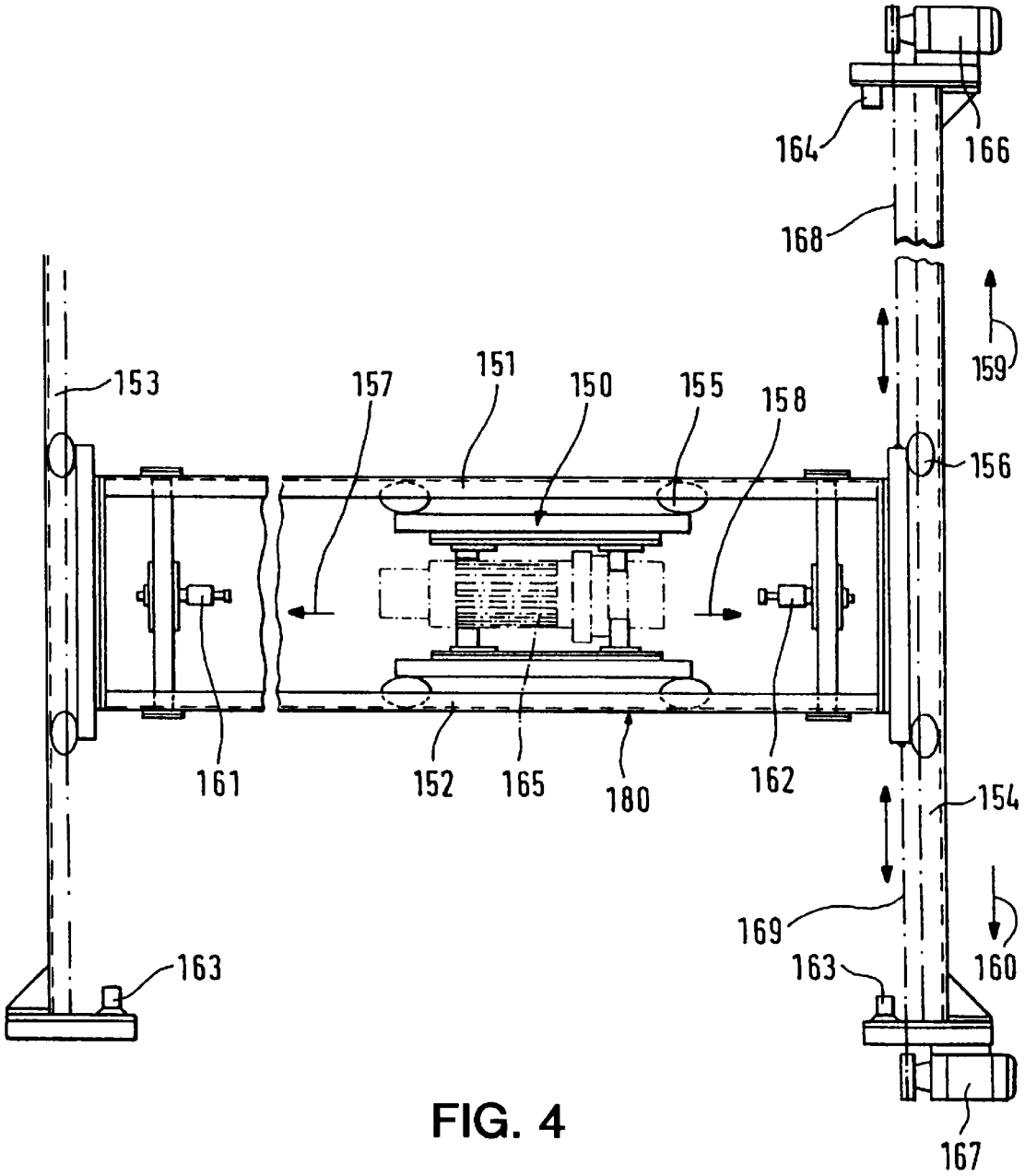
Figure 5:
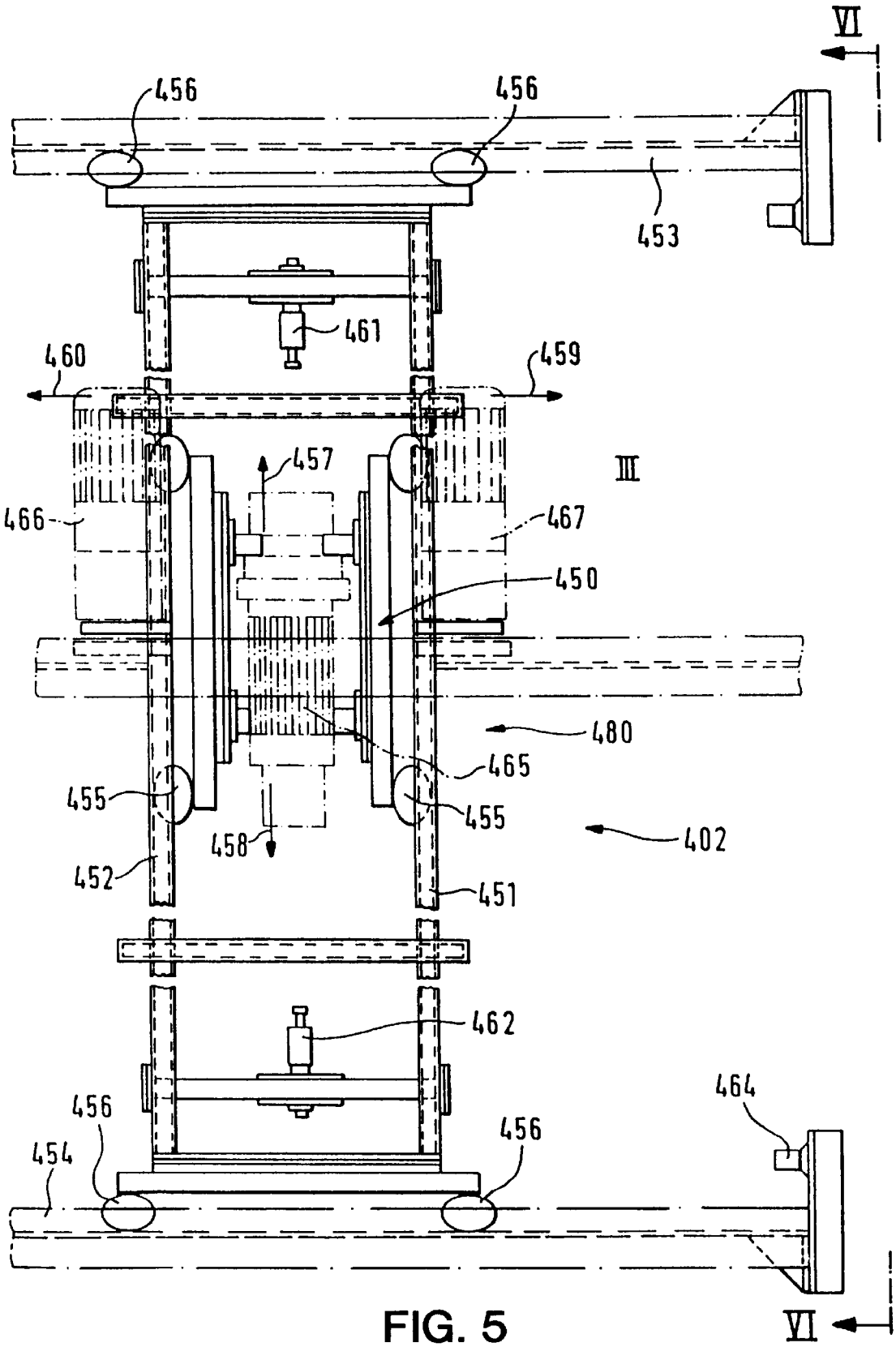
FIGS. 5–9 similarly illustrate an example of a lifting cable supported by overhead crane trolleys, where
Figure 6:
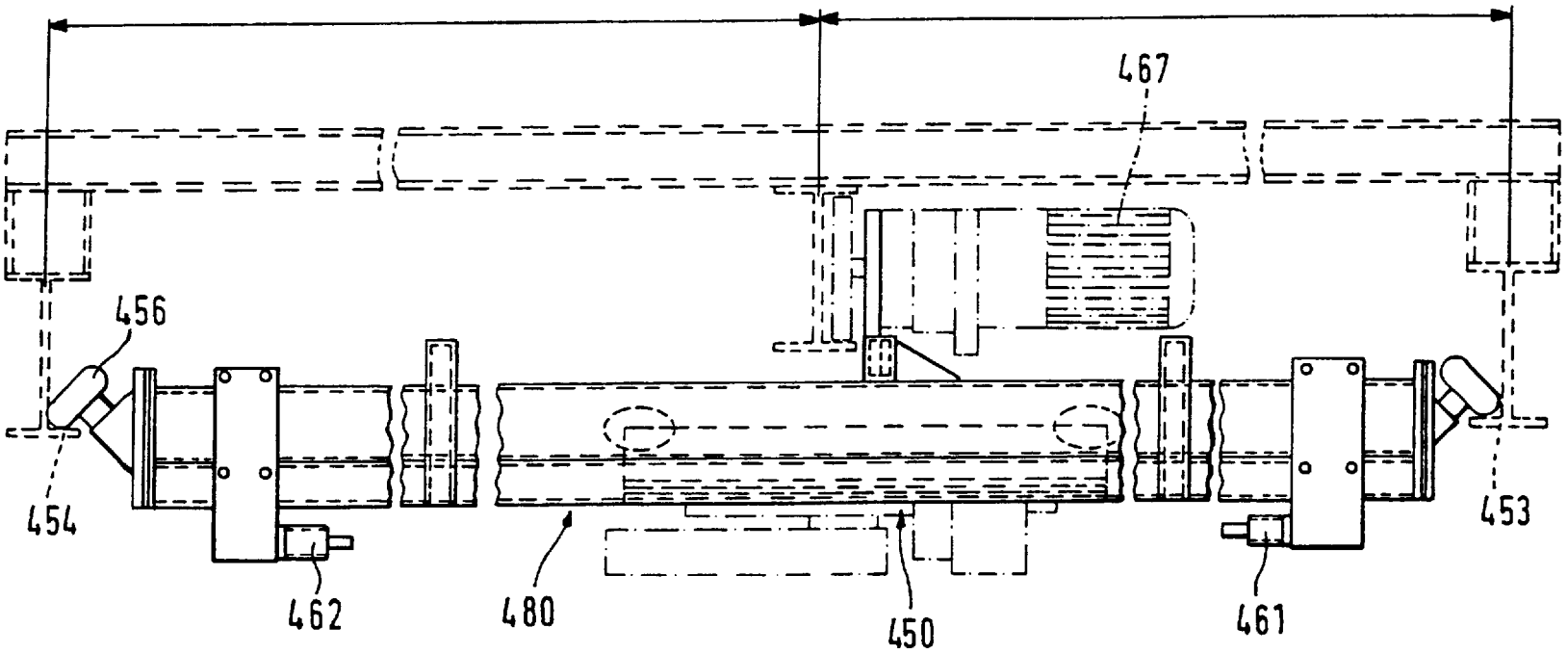
Figure 7:
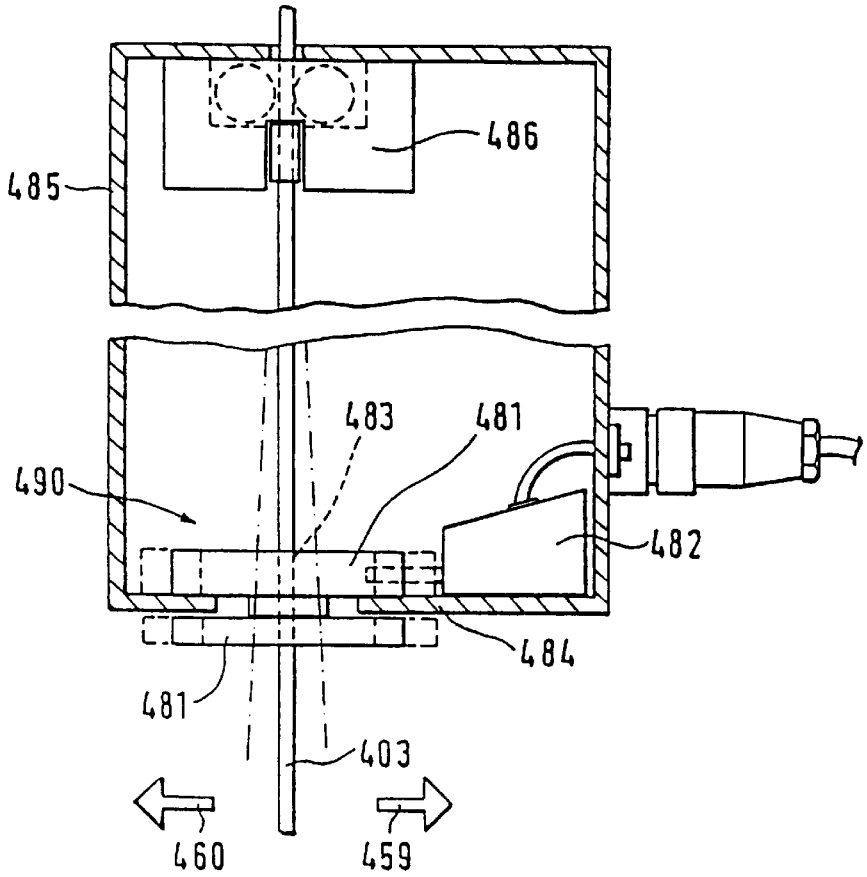
Figure 7A:
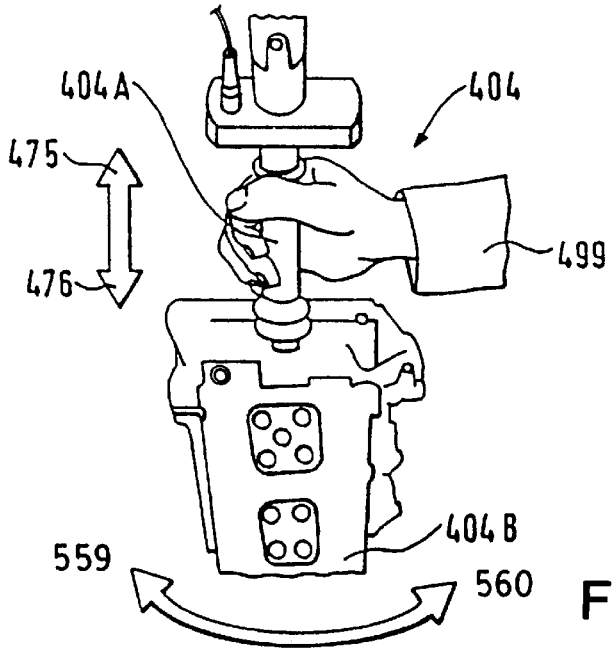
FIG. 7A shows a perspective view of a load lifting device.
Figure 8:
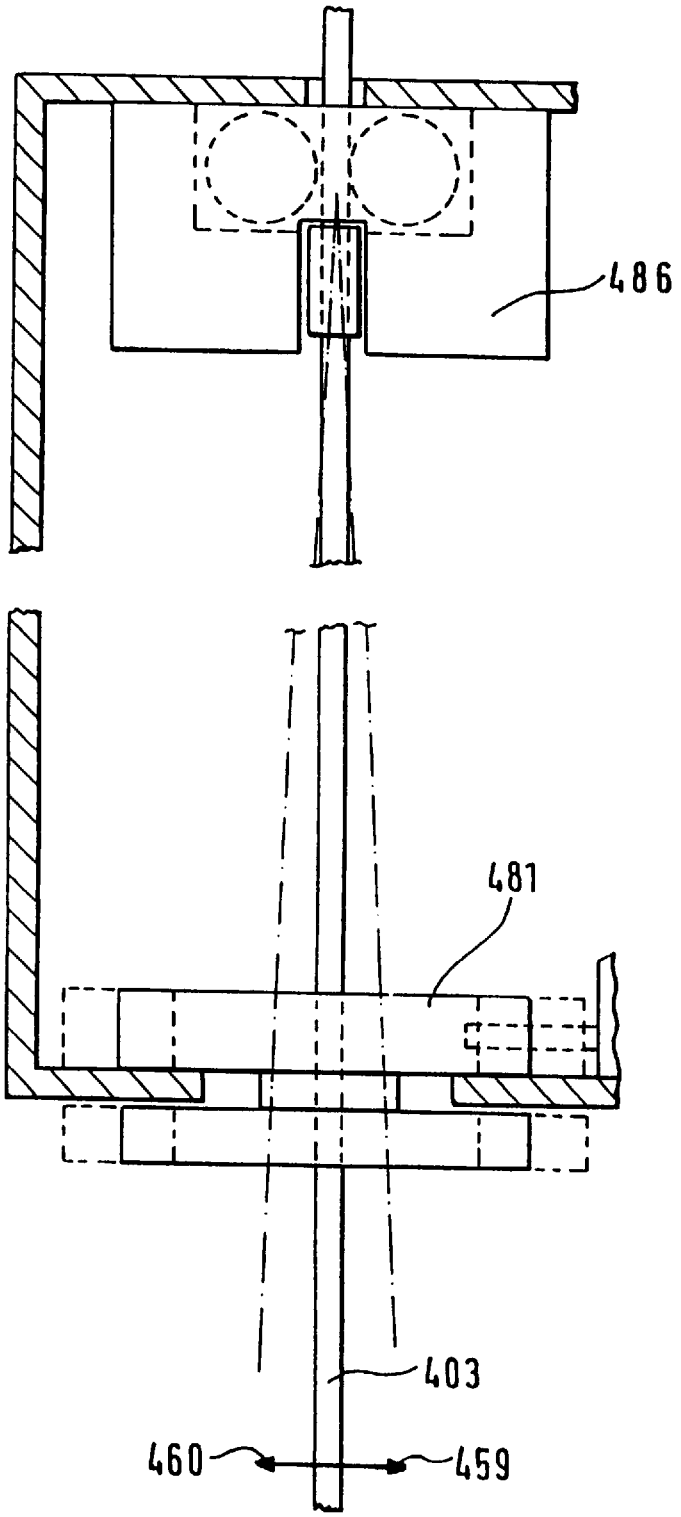

In the case of a second illustrative embodiment II, as illustrated in the drawings in FIGS. 3–4, a load device 104 is supported by a transport trolley 150, which is controlled in such a way as to run along tracks 151, 152, which tracks 151, 152 can form an overhead traversing trolley 180, which can be controlled to run along further tracks 153, 154 extending across said tracks 151, 152, on guide wheels and runners 155, 156 or other roller or slide devices, the movement of which trolleys in the horizontal direction 157, 158 and 159, 160 can be limited by dampers 161, 162 and 163, 164.

Driving means for driving said first trolley 150 and load device 104 can comprise a number of motors 165 supported by said trolley 150, and driving means for driving said second trolley 180 in its directions of travel 159, 160 can comprise motors 166, 167 operating in pairs which are connected to the trolley 180 via a cable 168, 169 in such a way that it is driven in the desired direction 159, 160, depending on the direction in which the associated lifting cable 103 is caused manually to move laterally in the desired direction of travel.

In the case of a third illustrative embodiment III, as illustrated in the drawings in FIGS. 5–9, a load device 404 is supported by a transport trolley 450, which is also controlled in such a way as to run along tracks 451, 452 on wheels 455 or other similar devices, and is capable of forming an overhead traversing trolley 480. The transport trolley 450 is preferably capable of manual operation by pulling on the load device 404 in the intended direction of lateral movement 457, 458. Said overhead traversing trolley, etc., 480 can be controlled so as to run along further tracks 453, 454, which extend across said first tracks 451, 452, on preferably angled driven guide wheels and runners 456 or other roller or slide devices. The movement of the trolleys 450, 480 in a horizontal direction 457, 458 and 459, 460 can be limited by dampers 461, 462 and 464.

Driving means for driving said load device 404 supported by the first trolley 480 an comprise an AC motor 465 of a previously disclosed kind, which can be fan-cooled and fitted with a gravity brake to act as a safety device in the event of power supply failure. The load device 404 can comprise a device of the aforementioned manually operated kind, which transmits signals, upon actuation of a control handle 404A in the desired direction of hoisting 475, 476, to the drive unit 465 for the purpose of hoisting the intended load 404B to the desired level with the hoist cable 403. Said so-called inner trolley 450 is capable of displacement manually between the dampers 461, 462 in the direction of the arrows 457, 458 along the tracks 451, 452 when the cable 403 is pulled in either of said directions 457, 458. The driving of the so-called outer travelling trolley 480 along the transverse tracks 453, 454 is effected advantageously, although not necessarily, with the help of two AC motors/solenoid motors 466, 467, which are in interaction with one another and are controlled by a signal transmitter, which are caused to move in a horizontal direction by the hoist cable 403 of the load hoist, depending on the direction 459, 460 in which the cable 403 is actuated.

The example illustrated here includes a movement transmission component 490, which comprises a position indicator control 481 interacting with the cable 403 and capable of movement laterally in relation to the cable 403. Said control 481 is connected to a potentiometer 482, or some other suitable position indicator, which is so arranged as to be actuated to a corresponding degree as the cable 403 is moved in a lateral sense 459, 460, and which is in connection with the associated drive motor 466, 467. The position indicator control 481 can be in the form of a slide, which accommodates the cable 403 in a transcurrent hole 483 or some other coupling component. The slide 481 is capable of guided displacement in the lateral sense 459–460 by an end wall 484 in a position guide housing 485, which at the top exhibits an input guide 486 for the cable 403, with which guide the cable is so arranged as to be capable of interacting.

Depending on the direction in which the cable 403 is caused to move in a horizontal sense in two mutually opposite directions, the driving of one of the motors is engaged by actuation of the cable 403 in the one direction for driving the trolley 480 in said one direction. Upon actuation of the cable 403 in the opposite direction, the other motor is so arranged as to be engaged for driving the trolley 480 in said opposite direction.

Figure 11:
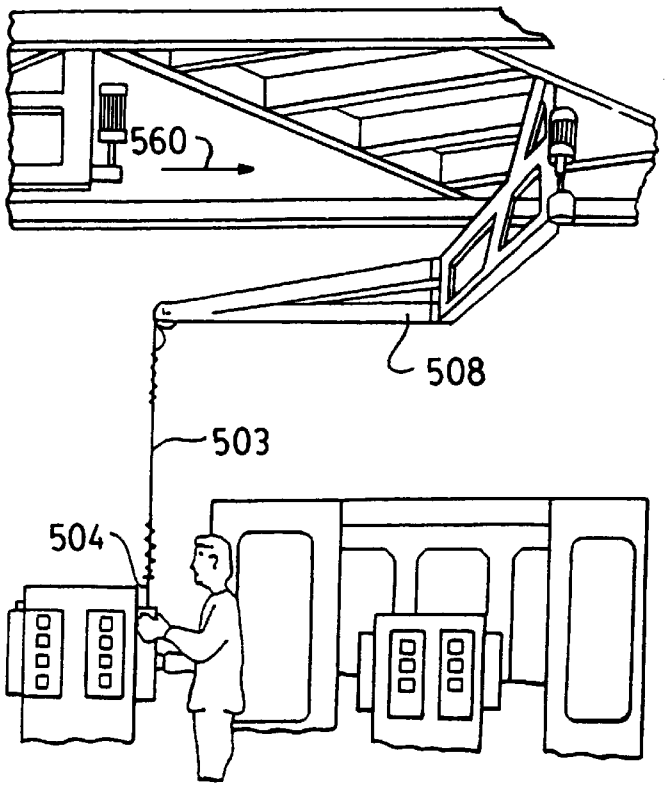
FIGS. 10–11 illustrate examples of a pivoting load hoist running along tracks.
Figure 10:
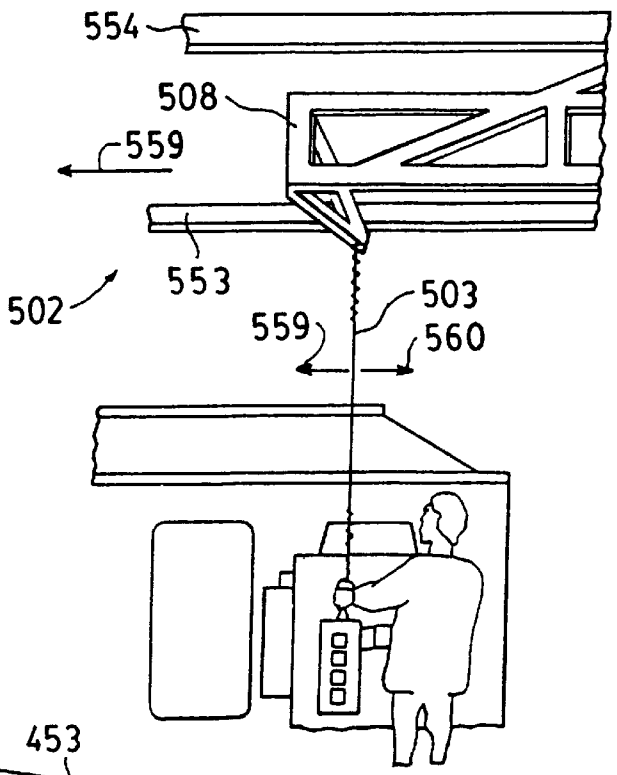
Figure 9:
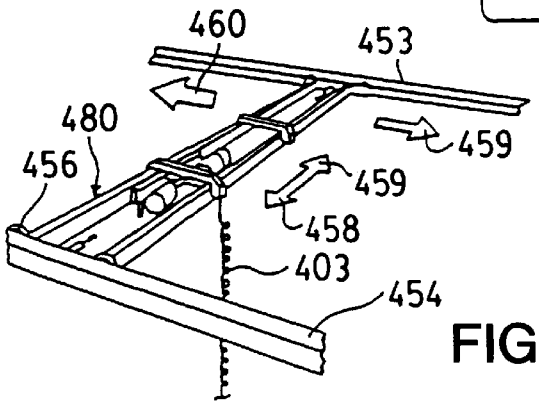
Figure 12:
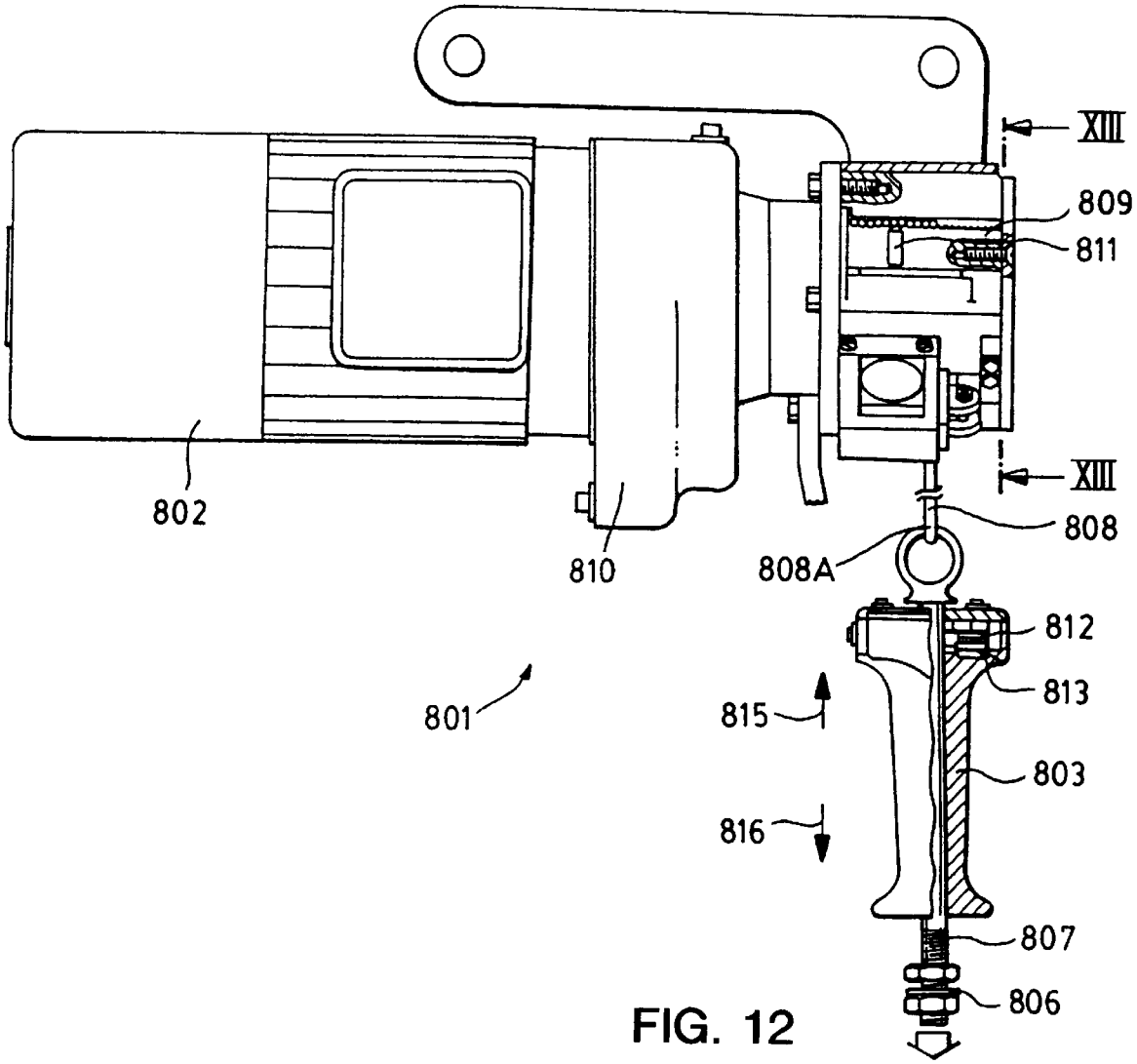
FIG. 12 shows a side view of a load hoist in accordance with the invention.
Figure 13:
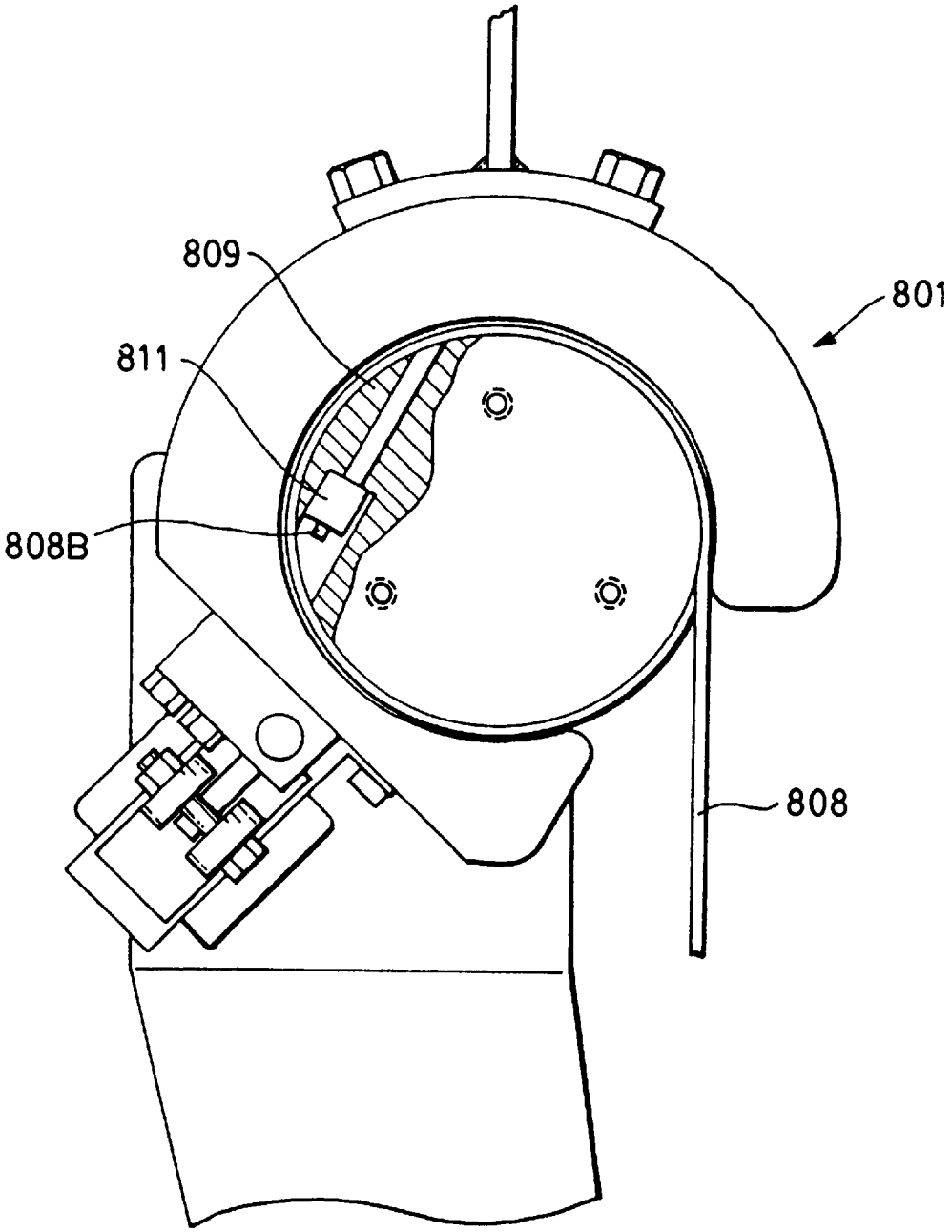
FIG. 13 shows a section through the hoist along the Line XIII—XIII.
Figure 14:
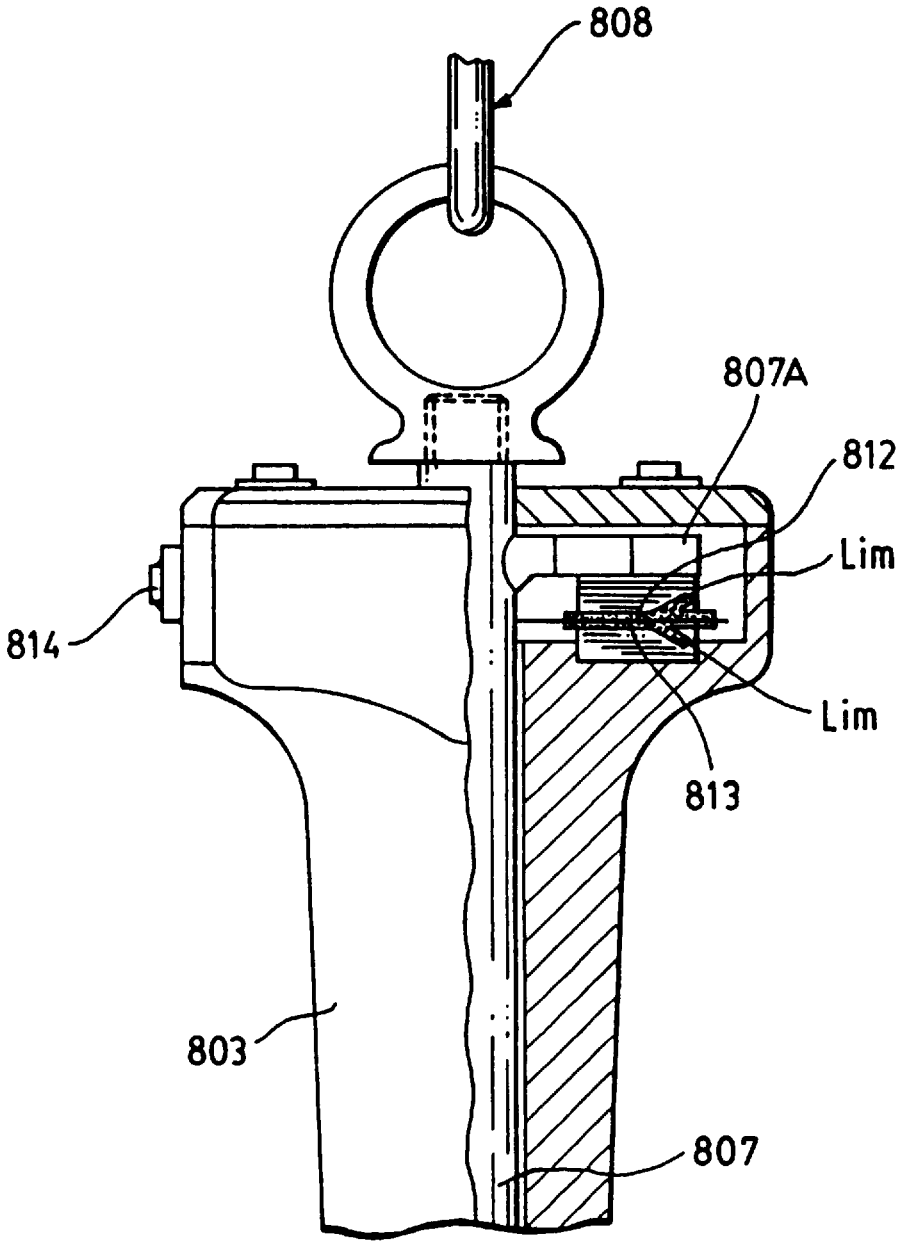
FIG. 14 shows a part of the operating control included in the hoist arrangement.

In the case of a fourth illustrative embodiment IV of the invention, as illustrated in the drawings in FIGS. 10–11, a lifting arm 508 of variable length, which supports driving means arranged for the driving in a horizontal direction of a load device 504 supported by a lifting cable 503, for the purpose of varying the length of the lift arm and/or of driving the arm 508 in the longitudinal direction 559, 560 of the tracks 453, 454 in question in a horizontal sense, is capable of actuation by the lateral movement imparted to the lifting cable in the desired direction of movement referred to.

As has already been mentioned above, said driving means 5; 165, 166, 167; 466, 467 are so arranged in accordance with the present invention as to be capable of being actuated by the lateral movement of said lifting cable 3; 103; 403 in such a way as to be capable of displacing the supported load device 4; 404 with its associated load in the corresponding direction in the intended instances, for example when the load personnel 499 are manoeuvring the load device 4, 104; 404 manually and are causing it to move in the direction in which it is wished to move the load by means of the driving means 5; 165, 166, 167; 466, 467 referred to.

Now with reference to FIG. 1 only, which illustrates a preferred illustrative embodiment of an arrangement, it can be appreciated that a number of sensors 275A, 275B, which are situated at a mutual distance from one another, are so arranged as to be capable of actuation by a movement transmission element 276. Said element 276, which can be so arranged as to extend in between the sensors in a space 277 between same, is so arranged, by interaction with the cable 303, as to be caused by same to move in a corresponding direction 278, 279 to that in which the cable moves laterally.

Said element 276 preferably comprises a component which functions with gearing, which can consist of movably supported arm 280. The cable 303 is so arranged at the respective ends 280A, 280B of said arm as to interact with the arm 280, and the arm 280 is mounted preferably via an articulated link 281, which is supported by a suitable fixed mounting support 282. Between said ends 280A, 280B the arm 280 is connected to a movement transmission component 283.

The cable 303 preferably passes through an opening 284 in, or interacts in some other appropriate fashion with a connecting piece 285 extending sideways from the arm 280.

Furthermore, the movement transmission component 283 can comprise a piston capable of moving laterally 278, 279 in relation to the cable 303, which piston can be movably supported on a bearing shaft 286 extending in the direction of movement and interacting with the piston 283. Said bearing shaft 286 is held immovably by a fixed support 287, which can be supported by an arm 8, trolley 150, 180, etc.

An actuating finger 276 connected to said piston 283 is so arranged as to function as a movement transmission element in order distinctly to transmit lateral movements from the cable 303 to the sensor 275A, 275B concerned.

Thus, with reference to FIGS. 3–4, the system is so arranged as to be capable of sensing movement in a horizontal direction in a lifting cable 103, which is arranged on a transport trolley 150 and 180, which is guided along tracks 151–152 and 153–154, and which carries hoist machinery 165 for said lifting cable. Information from said cable sensing is so arranged as to be capable of being transmitted to the drive motor of the intended trolley and/or for sensing purposes, for example through the presence of a potentiometer.

Also, a signal transmitter 275A, 275B and/or a sensor capable of being actuated by the cable 103 is so arranged as to transmit lateral movement in the cable to a motor 165; 166, 167 capable of driving a trolley 150; 180, and preferably to a travelling motor 166, 167 connected to the crab travel cable of the trolley 180 and acting in the desired direction of movement of the cable.

With reference to FIG. 2, the ability to vary the length of the arm is so arranged as to be achieved by means of a signal-controlled arm driving motor 5.

An actuating component provided for the lateral movement of the cable is thus so arranged as to act along the longitudinal extent of the arm or along the final intended extent of the arm from the upright.

A simple and efficiently functioning arrangement of this kind 2; 102; 302; 402; 502 is thus capable of being obtained through the present invention, the function and the nature of which should have been appreciated on the basis of the foregoing and with reference to the drawings.

The present invention relates to an arrangement for a goods hoist which comprises an operating control capable of being actuated by a driving device and situated between a load device and driving devices.

The principal object of the present invention is in the first place to make available an arrangement of the kind described above which is simple and which functions efficiently without the need for great muscle power on the part of the user.

Said object is achieved by means of an arrangement in accordance with the present invention, which is characterized essentially in that the driving device is so arranged as to be controlled by electronics or by some other means which are capable of being connected to a transmitter contained in said operating control capable of manual actuation.

Shown in FIGS. 12–15 is an arrangement for a goods hoist 801 of a kind which is suitable for use on frequently recurring occasions for the lifting of loads rapidly and conveniently without the need for great physical effort and, for example, for positioning the load in a process machine or on a fixture or stack of pallets, etc., so that the user experiences the hoist 801 as if it were working in a so-called 'weight-less' state when working both with and without a load, which contains a solenoid motor 802 or some other suitable driving device so arranged as to be controlled by a transmitter contained in an operating control 803 capable of manual actuation and capable of connection to it. Suitable for use as the driving device 802 are a solenoid motor, a d.c. motor, a powder magnetic coupling and an eddy-current coupling, which can be used separately or in combination in an appropriate manner. The operating control 803 is situated between said motor and/or coupling which functions as a driving device 802 and a load device 806 of an appropriate kind which operates, for example, with a number of vacuum devices, electromagnets or clamping or gripping devices, etc. Said operating control 803 is executed preferably in the form of a handle fitted to a rod 807 or some other form of connection acting between the load device 806 and the driving device 802 and attached to a line 808. The line 808 is capable of being wound onto a line drum 809 so arranged, for example via a geared drive 810, as to be driven by said driving device 802. The operating control 803 is suitably situated at the free end 808A of the line 808, whilst the other end 808B of the line is capable of being connected to the drum via a line locking arrangement 811 in a previously disclosed fashion.

A solenoid motor 802, which is a multi-pole three-phase motor with a special winding configuration, permits a 'stand still' function and a constant torque to be maintained for long periods, the characteristics of a motor of this kind being such that the torque remains essentially constant irrespective of the speed of rotation.

Arranged in the handle 803, etc., are a number of force transmitters 812, 813 or other means which enable recording to take place of the movements imparted to the handle by an operator in relation to the necessarily downward movement of the load in question. Said manual force which is required in order to actuate, for example, two piezoelectric sensors 812, 813 incorporated in the handle 803 in order to achieve the desired adjustment and holding of the load is small, usually of the order of 20–50 g, and this force may also be adjustable in relation to the torque of the motor.

The two piezoelectric crystal sensors 812, 813 situated in the handle 803, which serve as force sensors, can be capable of connection to one another and to the handle 803 and a component 807A attached to the rod 807 by adhesive bonding, and may be capable of being activated after actuation of an actuating button 814, etc.

The signal from the upper sensor 812 is so arranged as to be proportional to the force imparted to the handle 803 in an upward sense 815, whilst the signal from the lower sensor 813 is similarly proportional to the force imparted to the handle 803 in a downward sense 816.

In order to provide the hoist with step-less sensitivity characteristics, the force applied to the handle 803 is allowed to control a ramp generator, which in turn is so arranged as to control the torque of the motor, for example, in which case, if a force is applied to the handle 803, the torque will increase at a rate which is proportional to the forces concerned. This also means that, if the handle 803 is kept stationary, the ramp generator will adopt a value such that the torque will correspond precisely to the load on the hoist, which means that the handle 803 can be released when in this position without the load exhibiting any tendency to move. The friction of the system thus constitutes the range of equilibrium.

The arrangement 801 is preferably so arranged as to be controlled electronically, whereas the motor torque is regulated automatically by means of so-called switched voltage control after actuation of said sensors 812, 813. When the handle 803 is caused to move upwards 815 the torque is increased until the drive begins to rotate, which is recorded by the sensor 812 having the Load removed from it when the operator attempts to keep the handle 803 stationary. When the operator wishes to produce a downward movement 816, he causes the handle 803 to move downwards, which is recorded by the sensor 813, causing the motor torque to reduce so that the load will fall. If the load falls faster than the movement of the hand, a force will occur in the sensor 813, which will rapidly increase the torque of the motor once more via the electronics. The desired 'weight-less' function is achieved by the sensor 812, 813 constantly recording the manual force (hand movements) of the operator and attempting by increasing or reducing the motor torque to bring this force to a zero value.

Figure 15:
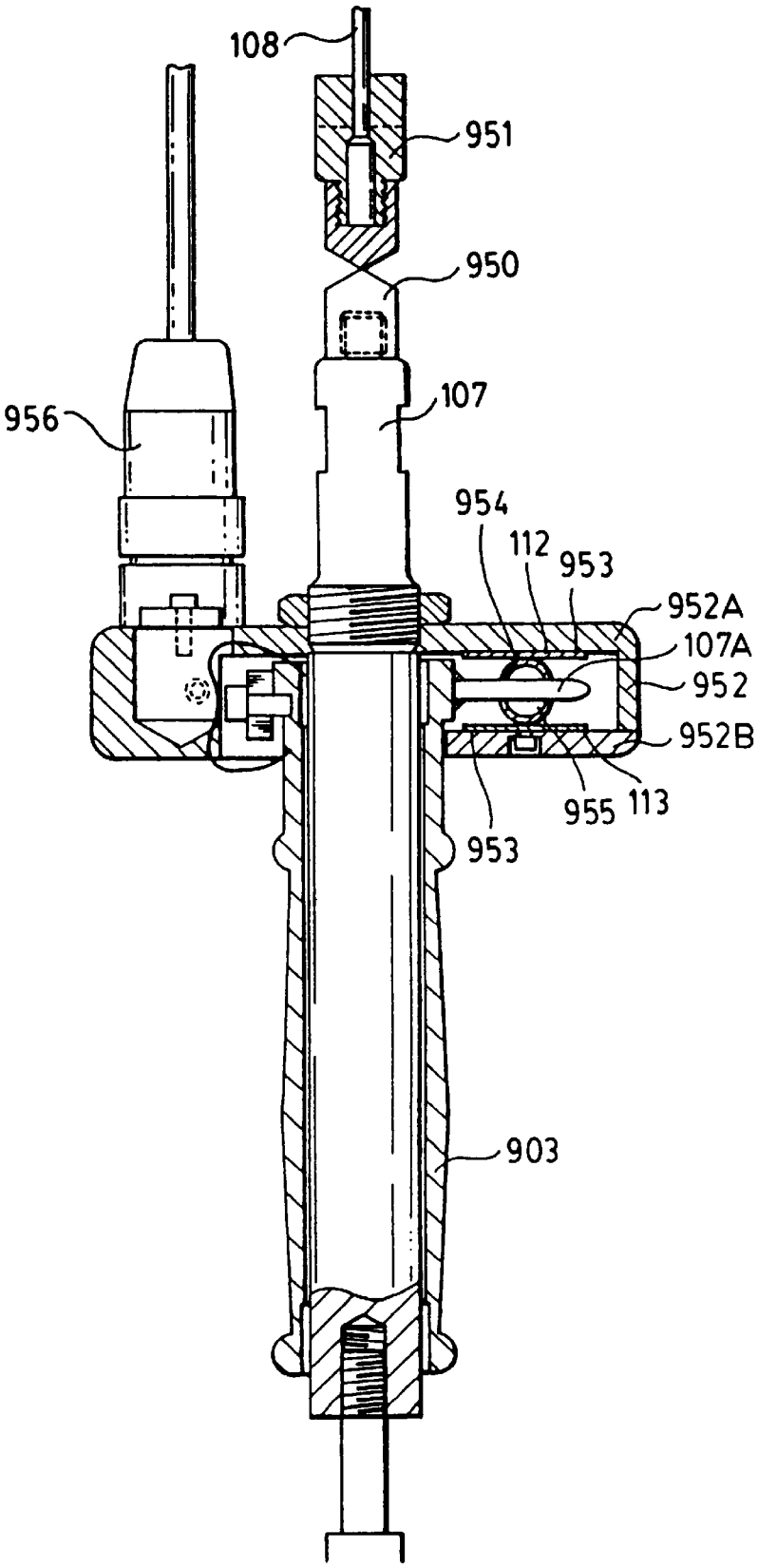
FIG. 15 shows a further design of an operating control.

The variant of an operating control illustrated in FIG. 15 consists of a handle 903 which is movably accommodated on a rod 107, which, via a ball-and-socket joint 950 and a line Locking device 951, is attached to a line 108. Attached to the rod 107 is a handle cover 952 which supports on each inside part of the upper and lower cover components 952A, 952B a sensor 112, 113, preferably of the type described above and preferably attached by means of double-sided tape 153.

Projecting laterally from the handle 903 and attached to the handle 903 is a tongue-shaped component 107A, which can support rubber plugs 154, 955 or other suitable actuating devices facing towards the sensors 112, 113 and capable of interacting with same, and is so arranged as to accompany the handle 903 as it is moved along the rod 107 in the intended direction, in so doing being able to actuate said sensors 112, 113 by means of said rubber plugs 954, 955, etc., so as to cause the information concerning the position of the handle and the rod relative to one another to be transmitted to the driving device in question via a connection 956 attached to the sensors 112, 113, said connection in the example illustrated constituting the female component of a contact.

Upward movement of the handle 903 thus actuates the sensor 112, whereas the sensor 113 is actuated by the actuating device 955 when the handle is moved downwards.

As described above, the second driving means allows movement of the load in one vertical direction, and also in a second vertical direction.

The invention is not restricted to the illustrative embodiment described above and illustrated in the drawings, but may be modified without restriction within the scope of the Patent Claims without departing from the idea of the invention.

It is thus possible to cause the two trolleys to move simultaneously when a lifting cable of the kind in question is moved in a direction at an angle to the perpendicular x and y co-ordinates. The sensors, etc., contained in the arrangement can be of a previously disclosed kind, for example of the kind referred to in the aforementioned publication.

We claim:

1. A load hoist arrangement comprising a lifting cable, a manually controllable load device supported by the lifting cable, a first driving means for driving said load device in a horizontal direction, a horizontal movement transmission element, said movement transmission element having a slidable position indicator control which is laterally slidable in reaction to a lateral movement of the lifting cable, a first potentiometer which is actuated by said slidable position indicator control, a transport trolley mounted on said first driving means and having a hoist machinery connected with said lifting cable, said transport trolley movable in at least two opposite horizontal directions, said first driving means including at least two drive motors for driving said trolley in said two opposite horizontal directions, and means for connecting each of said drive motors with said position indicator control, whereby a manual lateral movement in one direction of said lifting cable by an operator actuates said movement transmission element such that said position indicator control transmits a signal to one of said drive motors, causing said one drive motor to drive said trolley in the same direction as the manual lateral movement of said lifting cable, and whereby a manual lateral movement of said lifting cable in an opposite direction to said one direction likewise causes the trolley movement in an opposite direction, said hoist machinery including a second driving means for driving said load device in a vertical direction, a second movement transmission element having a vertical position indicator control which reacts to a vertical movement of a lifting cable handle means, and a second potentiometer which is actuated by the vertical position indicator control, whereby a manual vertical movement of the lifting cable handle means in one vertical direction by an operator actuates the second movement transmission element such that the vertical position indicator control transmits a signal to the second driving means, whereby the load device is moved in said one vertical direction, and whereby manual vertical movement of the lifting cable handle means in a second vertical direction causes movement of the load device in said second vertical direction.

* * * * *